US010648702B2

(12) United States Patent
Verma et al.

(10) Patent No.: US 10,648,702 B2
(45) Date of Patent: May 12, 2020

(54) LOW CAPACITY, LOW-GWP, HVAC SYSTEM

(71) Applicant: Carrier Corporation, Jupiter, FL (US)

(72) Inventors: Parmesh Verma, South Windsor, CT (US); Frederick J. Cogswell, Glastonbury, CT (US); William T. Cousins, Glastonbury, CT (US); Vishnu M. Sishtla, Manlius, NY (US); Ulf J. Jonsson, South Windsor, CT (US); Larry D. Burns, Avon, IN (US)

(73) Assignee: Carrier Corporation, Palm Beach Gardens, FL (US)

( * ) Notice: Subject to any disclaimer, the term of this patent is extended or adjusted under 35 U.S.C. 154(b) by 62 days.

(21) Appl. No.: 15/750,333

(22) PCT Filed: Aug. 11, 2016

(86) PCT No.: PCT/US2016/046540
§ 371 (c)(1),
(2) Date: Feb. 5, 2018

(87) PCT Pub. No.: WO2017/027701
PCT Pub. Date: Feb. 16, 2017

(65) Prior Publication Data

US 2018/0224168 A1 Aug. 9, 2018

Related U.S. Application Data

(60) Provisional application No. 62/203,861, filed on Aug. 11, 2015.

(51) Int. Cl.

| | |
|---|---|
| ***F25B 9/00*** | (2006.01) |
| ***F25B 1/053*** | (2006.01) |
| ***F25B 25/00*** | (2006.01) |

(52) U.S. Cl.
CPC ..... *F25B 9/006* (2013.01); *F25B 1/053* (2013.01); *F25B 25/005* (2013.01); *F25B 2400/121* (2013.01)

(58) Field of Classification Search
CPC ..... F25B 9/006; F25B 11/04; F25B 23/005; F25B 1/005; F25B 2400/12; F25B 31/002;
(Continued)

(56) References Cited

U.S. PATENT DOCUMENTS 3,960,468 A * 6/1976 Boorse ..... F04D 13/0613 417/423.13
4,626,168 A * 12/1986 Osborne ..... F04D 29/444 415/208.3
(Continued)

FOREIGN PATENT DOCUMENTS

WO 03/072946 A1 9/2003
WO 2005/067555 A2 7/2005
(Continued)

OTHER PUBLICATIONS

International Search Report and Written Opinion dated Oct. 27, 2016 for PCT Patent Application No. PCT/US2016/046540.
(Continued)

*Primary Examiner* — Emmanuel E Duke
(74) *Attorney, Agent, or Firm* — Bachman & LaPointe, P.C.

(57) ABSTRACT

A system (20; 300) comprises: a vapor compression loop (38; 338); a low-pressure or medium-pressure refrigerant in the loop; a centrifugal compressor (42) along the vapor compression loop and comprising: a housing (120); an inlet (44); an outlet (46); an impeller (140); an electric motor
(Continued)

(122) coupled to the impeller to drive rotation of the impeller; and one or more refrigerant-lubricated bearings (130, 132).

20 Claims, 3 Drawing Sheets

(58) Field of Classification Search
CPC ..... F25B 1/04; F04D 29/5866; F04D 17/08; F04D 25/0606; F04D 29/62; F04D 29/057; F04D 29/056
See application file for complete search history.

(56) References Cited

U.S. PATENT DOCUMENTS 5,881,564 A * 3/1999 Kishimoto ..... F04D 27/0292 62/193
5,884,498 A * 3/1999 Kishimoto ..... F25B 1/053 62/228.1
7,413,675 B2 8/2008 Minor
7,686,586 B2 * 3/2010 Nikpour ..... F04D 29/284 416/223 A
8,574,451 B2 11/2013 Hulse et al.
8,703,690 B2 4/2014 Van Horn et al.
8,765,004 B2 7/2014 Kontomaris et al.
2005/0008484 A1 * 1/2005 Nikpour ..... F04D 29/4213 415/206
2006/0242985 A1 11/2006 Leck et al.
2006/0245944 A1 11/2006 Leck et al.
2006/0266976 A1 11/2006 Minor et al.
2008/0232959 A1 * 9/2008 Nikpour ..... F04D 29/284 415/206
2011/0120175 A1 5/2011 Kamishima et al.
2011/0194960 A1 * 8/2011 Wu ..... F04D 25/0606 418/1
2012/0167599 A1 7/2012 Kontomaris
2012/0207585 A1 * 8/2012 Anderson ..... F04D 25/082 415/116
2013/0091843 A1 4/2013 Zyhowski et al.
2014/0165626 A1 * 6/2014 Van Horn ..... F25B 9/006 62/79
2014/0174110 A1 * 6/2014 Van Horn ..... C09K 5/044 62/77
2014/0260376 A1 * 9/2014 Kopko ..... F25D 3/005 62/99
2014/0260404 A1 * 9/2014 Verma ..... F25B 9/008 62/333
2014/0341710 A1 * 11/2014 Creamer ..... F16C 33/1005 415/111
2014/0360210 A1 * 12/2014 Lapp ..... F25B 1/053 62/84

FOREIGN PATENT DOCUMENTS

WO 2008/112591 A2 9/2008
WO 2013/093479 A2 6/2013
WO 2014/022610 A1 2/2014
WO 2014/158329 A1 10/2014
WO 2014/158468 A1 10/2014
WO 2014/179032 A1 11/2014
WO WO-2014179032 A1 * 11/2014 ..... F25B 1/053

OTHER PUBLICATIONS

The New EU HFC Regulations, What it Means for the HVAC Industry?, Jul. 2014, Trane Newsletter, vol. 22, Trane Hong Kong, Kwai Chung, New Territories, Hong Kong.
ASHRAE Position Document on Refrigerants and their Responsible Use, Jul. 2, 2014, ASHRAE, Atlanta, Georgia.

* cited by examiner

LOW CAPACITY, LOW-GWP, HVAC SYSTEM

CROSS-REFERENCE TO RELATED APPLICATION

Benefit is claimed of U.S. Patent Application No. 62/203,861, filed Aug. 11, 2015, and entitled "Low-Capacity, Low-GWP, HVAC System", the disclosure of which is incorporated by reference herein in its entirety as if set forth at length.

BACKGROUND

The disclosure relates to heating ventilation and air conditioning (HVAC) systems. More particularly, the disclosure relates to small capacity systems such as residential air conditioning (AC) or heat pump systems.

A common configuration of small capacity residential HVAC system is a split single loop system wherein an outdoor unit includes the compressor and an outdoor heat exchanger (heat rejection heat exchanger in a cooling/air conditioning mode) and an associated fan. An indoor unit includes an indoor heat exchanger (heat absorption heat exchanger or evaporator in the cooling/air conditioning mode) and associated fan. The indoor unit may be associated with ducts for delivering air throughout the building. An exemplary compressor is a rotary or scroll compressor which may be synchronously electrically driven. An exemplary refrigerant is R410A.

In the cooling/AC mode, refrigerant cooled in the outdoor heat exchanger is passed via a refrigerant line to the evaporator. An expansion device may be located in the indoor unit to further reduce refrigerant temperature prior to its passing through the indoor heat exchanger. Warmed refrigerant vapor is then passed from the indoor unit back to the compressor.

For more than a decade, efforts have been made to develop systems using low global warming potential (GWP) refrigerants. One example of a low-GWP refrigerant is R1233zd(E) (hereafter simply "R1233zd"). Whereas, R410A has a direct GWP of 2088, R1233zd has a direct GWP of less than 1.0. R1233zd also has a higher cycle efficiency than R410A (e.g., by about 10% to 15%) due to lower discharge temperatures and lower expansion losses. Nevertheless, R1233zd suffers from being a low pressure refrigerant. A low pressure refrigerant is defined by the United States Environmental Protection Agency (EPA) as having a saturation pressure less than 45 psia (310 kPa) (R1233zd has a saturation pressure of 31 psia (214 kPa)) at 104° F. (40° C.). Low pressure refrigeration systems typically operate at evaporator pressures (thus compressor suction pressures) less than atmospheric pressure or the ambient pressure which might slightly differ from 1 ATM due to weather, altitude, etc.

R410A (saturation pressure 352 psia (2.43 MPa) at 104° F.) is a high-pressure refrigerant (saturation pressure 170 psia (1.17 MPa) to 355 psia (2.45 MPa) at 104 F). R134a (saturation pressure 147 psia (1.01 MPa) at 104° F.) is a medium pressure refrigerant (saturation pressure 45 psia (310 kPa) to 170 psia (1.17 MPa) at 104° F.).

R1233zd also has benefits of being non-flammable and nontoxic (rating A1 under ASHRAE Standard 34-2007; with "A" indicating non-toxic and "1" indicating non-flammability).

As a practical matter, R1233zd applicability has been limited to large capacity systems which tend to be less sensitive to size and packaging problems and tend to be less sensitive to up-front hardware costs.

SUMMARY

One aspect of the disclosure involves a system comprising: a vapor compression loop; a low-pressure or medium-pressure refrigerant in the loop; and a centrifugal compressor along the vapor compression loop. The compressor comprises: a housing; an inlet; an outlet; an impeller; an electric motor coupled to the impeller to drive rotation of the impeller; and one or more refrigerant-lubricated bearings.

In one or more embodiments of any of the foregoing embodiments, the impeller has a diameter at an outlet of not more than 5.0 inches (12.7 cm).

In one or more embodiments of any of the foregoing embodiments, the refrigerant comprises R1233zd(E).

In one or more embodiments of any of the foregoing embodiments, fluid in the vapor compression loop comprises said refrigerant and not more than 1000 ppm lubricant, by weight.

In one or more embodiments of any of the foregoing embodiments, the system further comprises: an indoor heat exchanger; and an outdoor heat exchanger.

In one or more embodiments of any of the foregoing embodiments, the outdoor heat exchanger is along the vapor compression loop.

In one or more embodiments of any of the foregoing embodiments, the outdoor heat exchanger is along a heat transfer loop.

In one or more embodiments of any of the foregoing embodiments, the indoor heat exchanger is along an indoor heat transfer loop.

In one or more embodiments of any of the foregoing embodiments, the refrigerant is a low toxicity, low flammability refrigerant such as an ASHRAE A1-rated refrigerant.

In one or more embodiments of any of the foregoing embodiments, the refrigerant has a saturation pressure not more than 170 psia (1.17 MPa) at 104° F. (40° C.).

In one or more embodiments of any of the foregoing embodiments, the saturation pressure at 104° F. (40° C.) is less than 45 psia (310 kPa).

In one or more embodiments of any of the foregoing embodiments, the refrigerant has less than 150 direct GWP.

In one or more embodiments of any of the foregoing embodiments, a method for using the system comprises driving the impeller at a speed of at least 20,000 rpm.

In one or more embodiments of any of the foregoing embodiments, the method further comprises operating with refrigerant entering the compressor at a pressure below atmospheric pressure.

Another aspect of the disclosure involves a method for operating a system, the system comprising: a vapor compression loop; a centrifugal compressor along the vapor compression loop and comprising: a housing; an inlet; an outlet; an impeller; and one or more bearings. The method comprises running the compressor at a speed of at least 20,000 rpm to drive a flow of refrigerant along the vapor compression loop so as to: pass a flow of the refrigerant to lubricate the one or more bearings; and provide refrigerant entering the compressor at a pressure below atmospheric pressure.

In one or more embodiments of any of the foregoing embodiments, the compressor is a single-stage compressor.

Another aspect of the disclosure involves a system comprising: a vapor compression loop; an indoor unit; and an outdoor unit. The indoor unit comprises: a centrifugal compressor along the vapor compression loop (and comprising: a housing; an inlet; an outlet; an impeller); an inter-loop heat exchanger positioned to provide heat exchange between the vapor compression loop and a heat transfer loop; and an indoor air heat exchanger along the heat transfer loop. The outdoor unit comprises an outdoor air heat exchanger along the vapor compression loop or in thermal communication with the vapor compression loop.

In one or more embodiments of any of the foregoing embodiments, the system further comprises one or more of: a low-pressure or medium-pressure refrigerant in the loop; and one or more refrigerant-lubricated bearings.

In one or more embodiments of any of the foregoing embodiments, the impeller has a diameter at an outlet of not more than 5.0 inches (12.7 cm).

In one or more embodiments of any of the foregoing embodiments, the outdoor air heat exchanger is along a second heat transfer loop; and the outdoor unit comprises a second inter-loop heat exchanger positioned to provide heat exchange between the vapor compression loop and the second heat transfer loop.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

As is discussed below, combinations of: system configurations; compressor configurations, sizes and operating parameters; and refrigerants, may be used to provide a viable system using low direct GWP refrigerant. The system configurations illustrated below involve particular multi-loop configurations. The compressor-related considerations include using centrifugal compressors, more particularly, small high-speed centrifugal compressors. Refrigerant considerations include using a low pressure, low-GWP, refrigerant and using it in an oil-free or refrigerant-lubricated bearing situation. Exemplary essentially oil free situations involve oil concentrations of less than 5000 ppm in the fluid being passed to the bearings (and overall), more particularly, less than 1000 ppm or less than 500 ppm or less than 200 ppm. The remainder will essentially be refrigerant, optionally with minor additives (e.g., corrosion inhibitors) and contaminants (e.g., water). Exemplary aggregate non-oil additive concentrations are no more than 5.0% by weight, more particularly, no more than 2.0% or no more than 1.0% or no more than 5000 ppm or no more than 1000 ppm or no more than 500 ppm or no more than 200 ppm or no more than 100 ppm. Thus, exemplary fluid delivered to the bearings may comprise at least 95% by weight pure refrigerant or at least 98% or at least 99% or at least 99.5%.

As is noted above, a particular low-GWP refrigerant is trans-1-chloro-3,3,3-trifluoropropene (E-HFO-1233zd, alternatively identified as R1233zd(E) or simply R1233zd). A broader characterization of refrigerant beyond R1233zd is refrigerant having direct GWP of less than 150 GWP or less than 20 GWP or less than 5 GWP.

Figure 1:
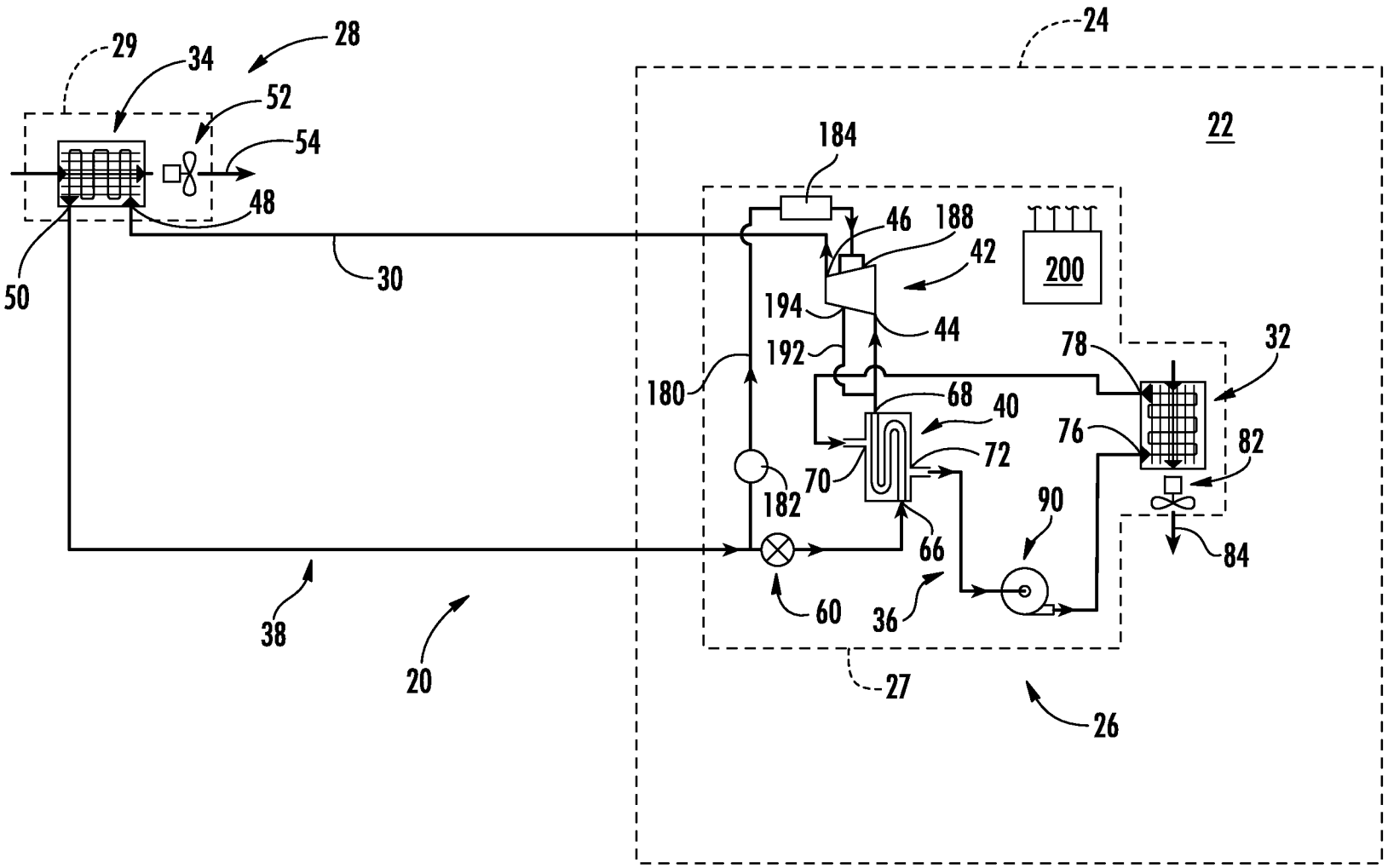
FIG. 1 is a schematic view of an HVAC system.

FIG. 1 shows an HVAC system 20 positioned to condition an interior 22 of a building 24. A system 20 comprises an indoor unit 26 within the building interior and an outdoor unit 28 outdoors. The indoor unit may have a housing 27 and the outdoor unit may have a housing 29. The exemplary system has a capacity of up to 20 tons refrigeration (TR) (70.3 kW) or, for exemplary split residential 3 (TR) to 5 TR (10.6 kW to 17.6 kW) or 2 TR to 6 TR (7.0 kW to 21.2 kW). Commercial units, particularly non-split packaged units have a broader distribution such as 5 TR to 20 TR (17.6 kW to 70.3 kW) for rooftop units or 5 TR to 12 TR (17.6 kW to 42.2 kW) for smaller such units.

The indoor unit 26 includes a heat exchanger 32. The outdoor unit 28 includes a heat exchanger 34. In a cooling mode, the indoor heat exchanger 32 is a heat absorption heat exchanger and the outdoor heat exchanger 34 is a heat rejection heat exchanger. In a heating mode (if provided; associated flow reversing hardware not shown), the indoor heat exchanger 32 is a heat rejection heat exchanger and the outdoor heat exchanger 34 is a heat absorption heat exchanger.

The exemplary system 20 is a two-loop system wherein a first loop 36 includes the heat exchanger 32 and a second loop 38 includes the heat exchanger 34. The exemplary first loop 36 is exclusively an indoor loop; whereas, the exemplary second loop 38 spans both indoor and outdoor locations and units. The two loops are in heat exchange relation with each other via a heat exchanger (inter-loop heat exchanger) 40. The exemplary second loop is a vapor compression loop or cycle using low-GWP refrigerant (e.g., 1233zd). The exemplary first loop 36 is merely a recirculating heat pipe loop and is not a vapor compression cycle.

The exemplary second loop 38 comprises a compressor 42 having an inlet or suction port 44 and an outlet or discharge port 46 along a recirculating refrigerant flowpath defined by the second loop 38. The compressor provides flow of low-GWP refrigerant that proceeds downstream from the discharge port to a refrigerant inlet 48 of the heat exchanger 34 and exits a refrigerant outlet 50. An exemplary heat exchanger 34 is a refrigerant-air heat exchanger wherein a fan 52 drives a flow of air 54 across the heat exchanger to absorb heat from the refrigerant in the normal cooling mode. The heat exchanger 34 may thus have its own air inlets and outlets and the overall outdoor unit 28 may similarly have inlets and outlets along an outdoor air flowpath. Refrigerant cooled in the heat exchanger 34 in the normal cooling mode passes downstream along the loop 38 to an expansion device 60 (e.g., an expansion valve such as a thermal expansion valve (TXV) or an electronic expansion valve (EEV or EXV)) or an orifice. Expansion of refrigerant in the expansion device 60 further reduces refrigerant temperature for entry to the second loop inlet 66 of the heat exchanger 40. In the heat exchanger 40, the refrigerant of the second loop absorbs heat from fluid in the first loop in the normal cooling mode and exits a refrigerant outlet 68 prior to returning to the suction port 44 of the compressor. The heat exchanger 40 is not a refrigerant-air heat exchanger. Depending upon the nature of the indoor loop fluid, the heat exchanger 40 may be identified as a refrigerant-refrigerant heat exchanger or as a refrigerant-water heat exchanger (e.g., where the first loop fluid may merely be a heat transfer fluid such as a brine or other aqueous solution).

The exemplary first loop 36 features fluid passing in recirculating fashion through the heat exchanger 40 from a first loop inlet 70 and out a first loop outlet 72. From the first loop outlet, the refrigerant ultimately passes to a fluid inlet 76 of the heat exchanger 32 and exits a fluid outlet 78. The exemplary heat exchanger 32 is also a refrigerant-air-heat exchanger having a fan 82 driving an air flow 84. The exemplary air flow 84 is a recirculating internal building air flow and may pass through supply and return ducts (not shown). Various implementations may add additional fresh air exchange and the like.

For driving fluid flow along the first loop 36, the exemplary first loop includes a pump 90 between the outlet 72 of the heat exchanger 40 and the inlet 76 of the heat exchanger 32. Accordingly, in this example, cooled fluid along the loop 36 exits the heat exchanger 40 as a liquid and is pumped by the pump 90 into the heat exchanger 32. In the heat exchanger 32, the fluid may at least partially evaporate in absorbing heat from the air flow 84. The vapor (and any residual liquid) returns to the inlet 70 of the heat exchanger 40 whereupon heat rejection to the second loop 38 allows the first loop fluid to condense back to liquid. An exemplary fluid in the first loop 36 may be a non-flammable fluid such as carbon dioxide (or majority by weight carbon dioxide).

As noted above, water or brine are alternative fluids for the first loop. Other alternatives involve the addition of phase change solids (e.g., encapsulated paraffin) to such liquid. In such a situation, the liquid containing the solids may pass to the heat exchanger 32 whereupon it at least partially melts to increase heat absorption from the air flow 84. The at least partially melted solids at least partially solidify in the heat exchanger 40 to then repeat the cycle.

The use of two loops, more particularly, the heat transfer loop with phase change as the first loop 36, helps mitigate the low pressure nature of the R1233zd by reducing the required vapor compression loop (second loop 38) pressure drop.

Figure 2:
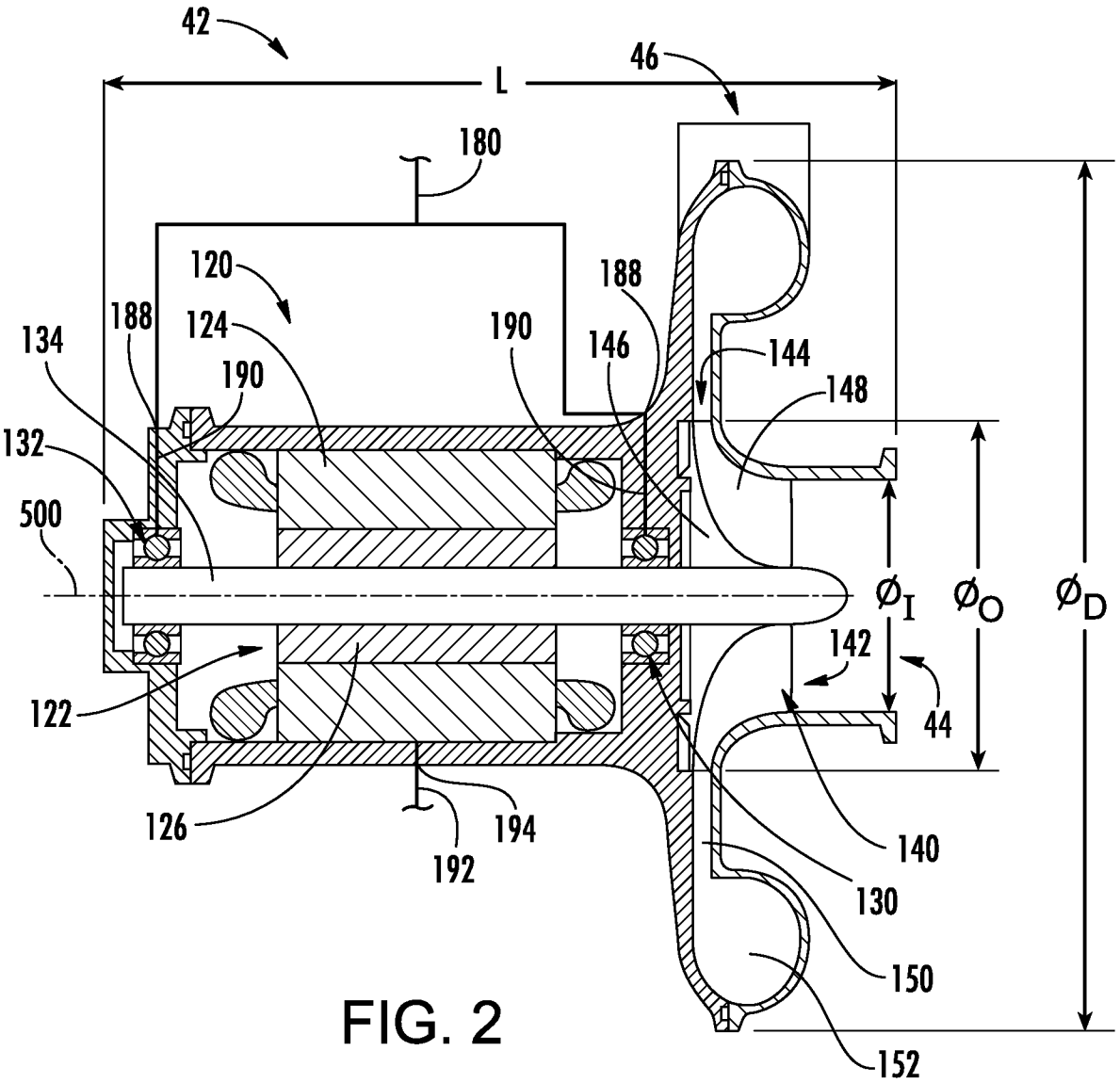
FIG. 2 is a longitudinal sectional view of a compressor of the HVAC system.

The exemplary second loop 38 compressor 42 is a centrifugal compressor. The exemplary centrifugal compressor is a single-stage, high-speed, centrifugal compressor (e.g., operating speed in excess of 20,000 rpm or other speeds discussed below). The exemplary impeller is relatively small (e.g., less than or equal to 5.0 inches (12.7 cm) or less than or equal to 4.0 inches (10.2 cm) or an exemplary 1.0 inch (2.5 cm) to 3.0 inch (7.6 cm). Impeller size is measured as diameter $Ø_O$ (FIG. 2) at the radial outlet. Alternative characterizations may involve impeller inlet diameter $Ø_I$ or overall diameter (e.g., a diffuser exterior diameter) $Ø_D$. FIG. 2 also shows an overall compressor length L.

An exemplary such compressor is a direct-drive, electric motor-driven, compressor.

FIG. 2 shows further details of the compressor 42 as comprising a housing or case assembly 120 including the suction port 44 and discharge port 46. The case contains an electric motor 122. The motor has a stator 124 fixed to the case and a rotor 126 mounted for rotation about an axis 500 by one or more bearing systems 130, 132. The exemplary bearing systems mount a shaft 134 to which the motor rotor may be mounted or otherwise integrated. The shaft 130 further mounts an impeller 140 having an axial inlet 142 and a radial outlet 144. The impeller has a hub 146 with a plurality of vanes 148 mounted to the hub. Optionally, the hub may bear an integral shroud or may be unshrouded (a shroud portion of the case serving the shroud function). Flow entering the suction port 44 passes to the impeller inlet 142 and is driven/compressed radially outward. Upon exiting the radial outlet 144, the flow passes radially through a diffuser 150 (e.g., a pipe diffuser, a vaneless diffuser, or the like) into a collector 152 and therefrom out the outlet 46.

An exemplary motor 122 is a high speed motor which may have a peak operating speed in the normal cooling mode of at least 20,000 rpm, or at least 25,000 rpm, or at least 30,000 rpm, or at least 40,000 rpm, or at least 50,000 rpm, and possibly as high as 200,000 rpm. Although the exemplary bearings are rolling element bearings (e.g., a ball bearing providing thrust and radial positioning at one end and a non-thrust roller bearing at the other) alternative combinations may involve hybrid bearings (e.g., wherein a magnetic bearing provides thrust positioning and rolling element bearings provide radial positioning).

To supply refrigerant to lubricate the bearings, a supply line 180 may branch from the loop 38 (e.g., upstream of the expansion device 60) to form a supply flowpath. The supply line may contain a pump 182, filter 184, control valve (not shown) or the like. The supply line (or branches of it such as shown may extend to ports 188 on the compressor that, in turn, communicate with internal lines 190 within the compressor to ports at the bearings. A return line or drain line 192 may extend from a drain port 194 of the compressor and rejoin the loop 38 on the low side such as at the interloop heat exchanger 40 or between the interloop heat exchanger and the suction port.

FIG. 1 further shows an optional controller 200. The controller may receive user inputs from an input device (e.g., switches, keyboard, or the like) and sensors (not shown, e.g., pressure sensors and temperature sensors at various system locations). The controller may be coupled to the sensors and controllable system components (e.g., valves, the bearings, the compressor motor, vane actuators, and the like) via control lines (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

The system and its components may be made using otherwise conventional or yet-developed materials and techniques.

A control routine may be programmed or otherwise configured into the controller. The routine may be the same as a baseline (e.g., using a scroll compressor) system or may provide additional functionality beyond that of the baseline system and may be superimposed upon the controller's normal programming/routines (e.g., providing the basic operation of a baseline system to which the additional control routine is added). Most small systems have very limited control features. A typical residential system may not even have any sensors beyond the sensors of the residence's thermostat(s). It relies on the thermostat to turn it on and off. A single control board in the gas-furnace may also turn the AC on when requested from the thermostat.

As is discussed below, one additional capability and associated control routine involves variable speed operation. In such a system, additional control features may be provided to vary the speed based. Rather than a simple on-off (cool-not cool) output, the thermostat may provide a demand signal such as proportional to a difference between sensed and set temperatures. The controller may vary motor speed based on the thermostat demand and operational pressures. Higher speed will be necessary for hotter outside temperatures, for example. Large centrifugal compressors typically also have inlet guide vanes for an additional level of capacity/pressure control, and may have variable diffusers. However small compressors may omit these.

Having the inter-loop heat exchanger 40 in close proximity to the compressor suction port allows for very low pressure drop between the two and thus increases efficiency. This is distinguished from a remote compressor situation (e.g., a compressor in the outdoor unit fed by a heat exchanger in the indoor unit) wherein one or more inefficiencies are required. In an oil-lubricated system, high speed flow is needed between the heat exchanger (either the indoor heat exchanger if a single loop system or the inter-loop heat exchanger if a multiple-loop system) and the compressor in order to properly entrain oil. In order to provide this high speed flow, a pressure drop will be required thus impacting efficiency. Alternatively, in a remote compressor situation with a refrigerant-lubricated compressor (not requiring oil entrainment), it is possible to avoid the pressure drop by having an appropriately large diameter pipe between the heat exchanger and the compressor. However, this pipe imposes material costs. Thus, these considerations may have synergy with other factors that facilitate bringing the compressor into the indoor unit.

A typical prior art small capacity system uses a rotary or scroll compressor. Such compressors suffer from a number of problems. One problem is relatively large size. Size would be even further increased if using R1233zd instead of R410A. A high speed motor of a small centrifugal compressor may allow a much more compact configuration than an R410A scroll compressor.

Other problems involve efficiency. There are efficiency issues associated with oil lubrication reducing the efficiencies of the heat exchangers. Accordingly, replacement of the scroll compressor with a centrifugal compressor can present one or more of several advantages including compactness, general efficiency, and efficiency if an oil-free configuration is adopted. Although a large centrifugal may still be quieter than a scroll or other positive displacement compressor, they still present problems for indoor use. A small centrifugal compressor run at high speed may generate high frequency noise that is easier to attenuate by adding lagging. Exemplary lagging involves two layers. The inside layer (immediately adjacent to the vibrating compressor housing) is made of sound absorptive material (such as open cell foam or fiberglass). The outside layer is a flexible, damped, weighted material (e.g., mass-weighted vinyl) and may be thinner than the inner layer. The inner layer has two functions: to dissipate sound that is trapped inside the lagging; and to decouple the vibrating housing from the outer layer. The outer layer function is to trap the sound radiated by the housing by reflecting inward.

A synergistic effect also involves the relationship between the refrigerant and the compressor configuration and operating parameters. R1233zd has a higher cycle efficiency than R410A due to lower discharge temperatures and lower expansion losses. Direct use of R1233zd in a scroll compressor would require a very large compressor because volumetric flow of R1233zd would be approximately ten times that of R410A at a given capacity. Although the exemplary refrigerant is R1233zd, this is not meant to preclude other refrigerants that may be developed which have similar properties to R1233zd (low-pressure, low GWP, non-toxic, and non-flammable). R1233zd is a hydrochloroflouroolefin. Other currently commercialized olefin-based compounds developed are low-GWP, but are medium pressure and flammable. Future refrigerants developed may meet all four criteria.

An additional consideration relates to the powering of the compressor. The high speed centrifugal compressor requires a high speed inverter. This is distinguished from the synchronous powering of a scroll compressor. The high speed inverter hardware itself forms the basis of a variable speed drive. Accordingly, a variable speed operation is enabled at little or no additional cost once the high speed inverter is in place. This allows for higher efficiency operation, particularly adjusting for seasonal variations.

Figure 3:
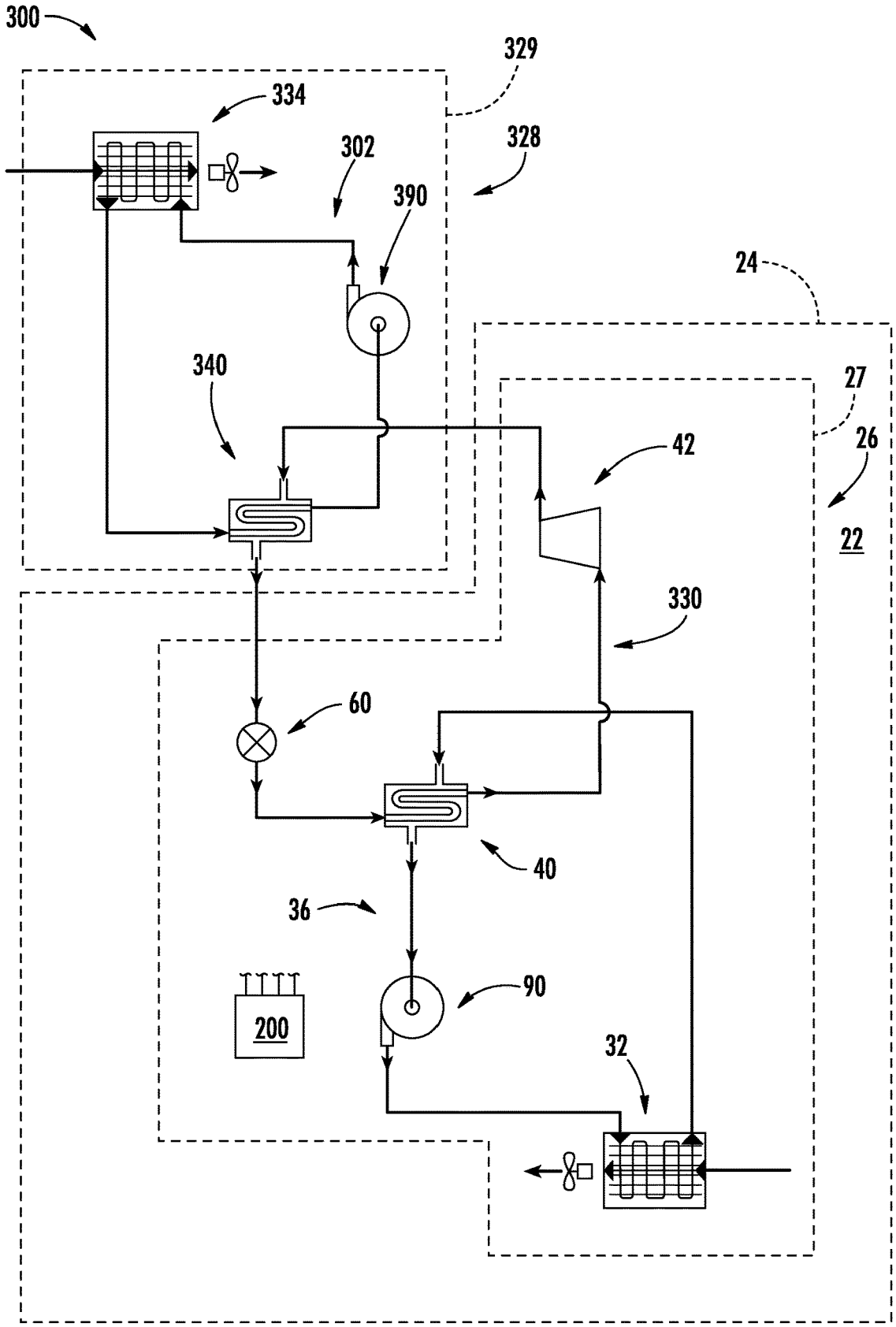
FIG. 3 is a schematic view of a second HVAC system.

FIG. 3 shows an alternative system 300 formed as a three-loop system wherein the first loop 36 is essentially the same as in FIG. 1 (bearing refrigerant supply and return/drain components not shown for ease of illustration but otherwise similar to FIG. 1). However, an additional loop (outdoor loop) 302 is added featuring the outdoor heat exchanger and is in thermal communication with the vapor compression loop to absorb heat from the vapor compression loop 338 in the normal cooling mode. In an example of a split unit, the indoor-outdoor split is similar to that of FIG. 1 in that the indoor unit 26 includes the vapor compression system compressor, expansion device and inter-loop heat exchanger 40 for communication with the indoor loop. The inter-loop heat exchanger 340 for communication with the outdoor loop is, like the FIG. 1 outdoor heat exchanger located as part of the outdoor unit 328 in housing 329. Again, phase change in the outdoor loop may help reduce the pressure drop required for the vapor compression loop.

Among other variations are eliminating the pumps 90, 390 to rely on gravity operation for the heat pipe loops 36, 328. For example, in the indoor loop 36, without a pump the inter-loop heat exchanger 40 may be a shell and tube heat exchanger with vertically-oriented tubes carrying the fluid of the indoor loop.

In the indoor (heat absorption in the cooling mode) heat exchanger 32 the two-phase fluid (e.g., $CO_2$ discussed above) enters the bottom of the tube array and is warmed/boiled by heat transfer from the indoor air flow and so that vapor comes out the top and flows back to the inter-loop heat exchanger 40. That vapor enters the top of the tube array where it rejects heat to refrigerant within the shell of the inter-loop heat exchanger 40 and condenses. As the fluid condenses it flows down and accumulates at the bottom of the inter-loop heat exchanger 40. The indoor heat exchanger 32 may be located at a lower height than the inter-loop heat exchanger 40 so that the condensed fluid flows by gravity to the indoor heat exchanger 32 (because the liquid column weighs more than the vapor column).

In the pump-free outdoor loop, the outdoor heat exchanger 334 may have vertically-oriented tubes with fluid entering from the top of the tube array and the inter-loop heat exchanger 340 may be a shell-and tube heat exchanger with vertical tubes and fluid entering from the bottom of the tube array.

Although split systems are illustrated, alternative systems may be "packaged" such as in rooftop systems. In an example of such a system as a rooftop system, all components including what would otherwise be the indoor heat exchanger are in the outdoor package and may be in a single housing. Supply and return ducts may couple that indoor heat exchanger to the building interior.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. A system (20; 300) comprising:

a vapor compression loop (38; 338);

a low-pressure or medium-pressure refrigerant in the loop; and a centrifugal compressor (42) along the vapor compression loop and comprising:

a housing (120);

an inlet (44);

an outlet (46);

an impeller (140);

an electric motor (122) coupled to the impeller to drive rotation of the impeller; and one or more refrigerant-lubricated bearings (130, 132), wherein:

the impeller has a diameter at an outlet of not more than 5.0 inches (12.7 cm); and fluid in the vapor compression loop comprises said refrigerant and not more than 1000 ppm lubricant, by weight.

2. The system of claim 1 wherein:

the refrigerant comprises R1233zd(E).

3. The system of claim 1 further comprising:

an indoor heat exchanger (32); and an outdoor heat exchanger (34; 334).

4. The system of claim 3 wherein:

the outdoor heat exchanger (34) is along the vapor compression loop (38).

5. The system of claim 3 wherein:

the outdoor heat exchanger (334) is along a heat transfer loop (302).

6. The system of claim 5 wherein:

the indoor heat exchanger is along an indoor heat transfer loop (36).

7. The system of claim 6 wherein:

the indoor heat transfer loop is a phase change loop having a pump along a liquid portion of the heat transfer loop.

8. The system of claim 1 wherein:

the refrigerant is a low toxicity, low flammability refrigerant.

9. The system of claim 8 wherein:

the refrigerant is an ASHRAE A1-rated refrigerant.

10. The system of claim 1 wherein:

the refrigerant has a saturation pressure not more than 170 psia (1.17 MPa) at 104° F. (40° C.).

11. The system of claim 10 wherein:

the saturation pressure at 104° F. (40° C.) is less than 45psia (310 kPa).

12. The system of claim 1 wherein:

the refrigerant has less than 150 direct GWP.

13. A method for using the system of claim 1, the method comprising:

driving the impeller at a speed of at least 20,000 rpm.

14. The method of claim 13 further comprising:

operating with refrigerant entering the compressor at a pressure below atmospheric pressure.

15. The system of claim 1 wherein:

the one or more refrigerant-lubricated bearings (130, 132) are rolling element bearings.

16. A method for operating a system (20; 300), the system comprising: a vapor compression loop (38; 338); a centrifugal compressor (42) along the vapor compression loop and comprising: a housing (120); an inlet (44); an outlet (46); an impeller (140); and one or more rolling element bearings (130, 132), wherein: the compressor is a single-stage compressor with an impeller having a diameter at an outlet of not more than 5.0 inches (12.7 cm); and the method comprises running the compressor at a speed of at least 20,000 rpm to drive a flow of refrigerant along the vapor compression loop so as to: pass a flow of the refrigerant to lubricate the one or more bearings; and provide refrigerant entering the compressor at a pressure below atmospheric pressure.

17. A system (20; 300) comprising: a vapor compression loop (38; 338); an indoor unit (26) comprising: a centrifugal compressor (42) along the vapor compression loop and comprising: a housing (120); an inlet (44); an outlet (46); an impeller (140) having a diameter at an outlet of not more than 5.0 inches (12.7 cm); an inter-loop heat exchanger (40) positioned to provide heat exchange between the vapor compression loop and a heat transfer loop (36); and an indoor air heat exchanger (32) along the heat transfer loop; and an outdoor unit (28; 328) comprising: an outdoor air heat exchanger (34; 334) along the vapor compression loop or in thermal communication with the vapor compression loop.

18. The system of claim 17 further comprising one or more of:

a low-pressure or medium-pressure refrigerant in the loop; and one or more refrigerant-lubricated bearings (130, 132).

19. The system of claim 17 wherein:

the outdoor air heat exchanger is along a second heat transfer loop; and the outdoor unit comprises a second inter-loop heat exchanger (340) positioned to provide heat exchange between the vapor compression loop and the second heat transfer loop.

20. The system of claim 17 wherein:

the heat transfer loop is a phase change loop having a pump along a liquid portion of the heat transfer loop.

* * * * *